United States Patent [19]

Shelton

[11] 4,129,999

[45] Dec. 19, 1978

[54] RING GUARD ATTACHABLE BY MELTING END PORTIONS THEREOF

[76] Inventor: George W. Shelton, 5131-C Roadrunner Land, Austin, Tex. 78749

[21] Appl. No.: 760,097

[22] Filed: Jan. 17, 1977

[51] Int. Cl.[2] ..... A44C 9/02
[52] U.S. Cl. ..... 63/15.6
[58] Field of Search ..... 63/15.6

[56] References Cited

U.S. PATENT DOCUMENTS

| | | | |
|---|---|---|---|
| 808,273 | 10/1905 | Davidoff | 63/15.6 |
| 1,217,097 | 2/1917 | Levin | 63/15.6 |
| 1,858,861 | 5/1932 | Levin | 63/15.6 |
| 3,483,717 | 12/1969 | Mayer | 63/15.6 |
| 3,557,571 | 1/1971 | DeSanto | 63/15.6 |
| 3,603,109 | 9/1971 | Virtanen | 63/15.6 |

FOREIGN PATENT DOCUMENTS

| | | | |
|---|---|---|---|
| 5525 of | 1906 | United Kingdom | 63/15.6 |

*Primary Examiner*—F. Barry Shay
*Attorney, Agent, or Firm*—Marcus L. Bates

[57] ABSTRACT

A ring guard for use in combination with a finger ring which compensates for the difference in size between one's finger and the internal diameter of the ring.

The guard includes an elongated resilient finger engaging main body member having a mid-section which is spaced from the inner surface of the ring shank. The marginal opposed ends of the main body curve upwardly from the mid-section towards the interior of the shank, and terminate in a socket.

Each socket extends completely about and slidably captures spaced marginal lengths of the shank therewithin. The sockets are formed onto the ring by a transverse member having opposed lateral members which are bent about the shank and heatwelded together to form a unitary socket member.

2 Claims, 7 Drawing Figures

RING GUARD ATTACHABLE BY MELTING END PORTIONS THEREOF

BACKGROUND OF THE INVENTION

Most finger ring guards are made of metal and include a fastener means which usually requires a special tool for installation. A skilled technician is usually required in order to properly fit the guard to the ring. The metal-to-metal contact between the guard and the ring is objectionable because it continually scratches and therefore progressively damages the ring during its use. Many ring guards of the prior art discolor over a period of time and it is very difficult to properly clean the ring because of the presence of the guard.

Furthermore, the prior guards can be injurious to the wearer should the guard inadvertently become disorientated respective to the ring shank whereupon the sharp edges thereof are brought to bear against the finger of the wearer.

It would therefore be desirable to have made available an improved finger ring guard which overcomes the above drawbacks and which furthermore can be installed without the employment of special tools.

SUMMARY OF THE INVENTION

The present invention relates to jewelry, and specifically to apparatus for compensating for the difference in size of a ring respective to one's finger. The invention comprises a guard which is readily attachable in a permanent manner to the shank of a finger ring.

The finger ring guard of this invention has a main body member comprised of an elongated resilient finger engaging central body portion which upwardly curves about one's finger into engagement with opposed sockets located at either end of the guard. The sockets capture opposed marginal portions of the ring shank therewithin so that the sockets are slideable towards and away from one another as the central body portion is deformed by one's finger.

The opposed sockets of the ring guard are made of heat-meltable plastic. The sockets comprise opposed transverse members connected to and extending laterally away from the end of each of the curved members. Each transverse member is sufficiently pliable to admit being bent about the ring shank, and one transverse member is bent back upon the other, whereupon application of heat causes the two members to be melted together to thereby form the aforesaid socket which slideably captures the ring shank therewithin.

A primary object of the present invention is to provide a ring guard which compensates for a relatively broad range of different finger opening sizes of a finger ring.

Another object of the present invention is the provision of a finger ring guard by which the inside dimension of a finger ring is effectively changed without reducing the strength or dimensional stability of the ring.

A further object of this invention is to disclose and provide improvements in apparatus for compensating for the difference in size of one's finger and a finger ring.

A still further object of the present invention is to provide apparatus by which a finger ring is maintained properly and comfortably fitted about one's finger.

Another object of the invention is the provision of a permanent ring guard which can be fitted to a ring at any time by a layman.

Still another object of this invention is the provision of a unitary ring guard which is adapted to be fitted to a plurality of rings of different diameters.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
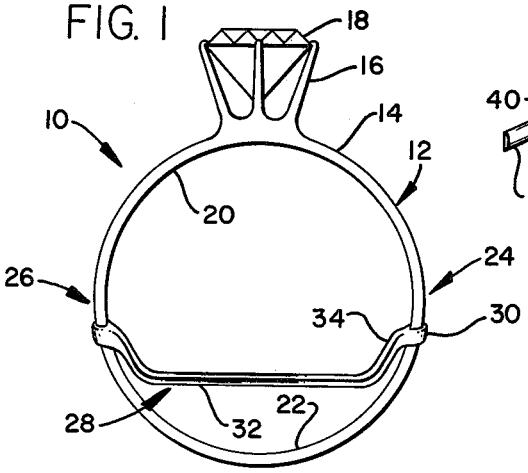
FIG. 1 is a side-elevational view of an ordinary ring of the prior art with a ring finger guard of the present invention illustrated in operative relationship therewith.

FIG. 1 discloses the combination 10 of the present invention, which includes an ordinary finger ring 12 which can take on several different forms. The ring has the usual shank 14 which slidably receives one's finger in a telescoping manner. A setting 16 mounts a stone 18 therein as may be desired. The inner circumferentially extending upper surface 20 is spaced from the lower inner circumferential surface 22 by the opposed sides 24 and 26 of the ring shank. This terminology enables exact orientation of a ring guard 28 made in accordance with the present invention.

The ring guard is connected to the opposed sides 24 and 26 of the shank by means of the illustrated opposed sockets 30. The ring guard comprises an elongated resilient finger engaging main body member which includes a mid-section 32. Each end 34 of the mid-section terminates in said socket.

Figure 2:
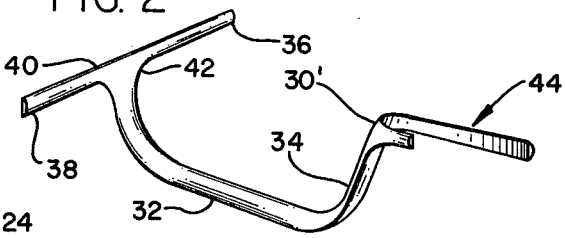
FIG. 2 is a perspective broken view of a ring guard made in accordance with the present invention.

As best seen in the illustration of FIG. 2, in conjunction with other Figures of the drawing, the ring guard of the present invention is fabricated in a manner to present transverse members 36 and 38 which have a marginal central portion 40 joined at 42 to the terminal ends of the beforementioned marginal end portions 34. The transverse members are laterally disposed respective to the main body.

Numeral 30' illustrates the fabrication steps of the sockets wherein two lateral members have been formed into an outwardly opening u-shaped configuration such that they extend parallel to one another as indicated by the numeral at 44.

Figure 3:
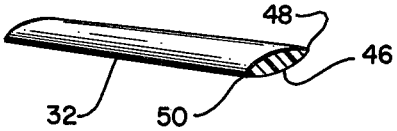
FIG. 3 is an enlarged partial perspective view of part of the apparatus disclosed in FIG. 2.
Figure 4:
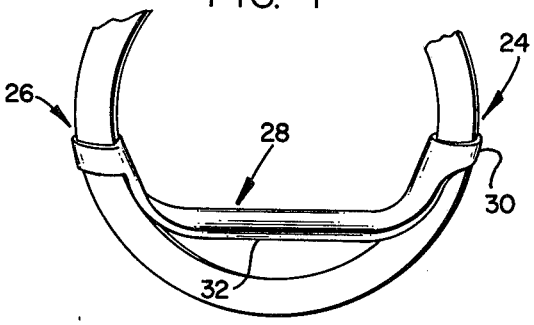
FIG. 4 is an enlarged fragmented perspective view of FIG. 1.

In the illustration of FIG. 3, the mid-section 32 of the main body member is made of resilient plastic material 46 having parallel edge portions 48 and 50. The mid-section is preferably lenticular in cross-sectional configuration and progressively changes in an outward direction so that the marginal ends progress into a flat outer surface and curved inner surface at 34. The flat outer surface continues at the lateral members so that a flat inside and curved outside surface is achieved for formation of the socket.

Figure 5:
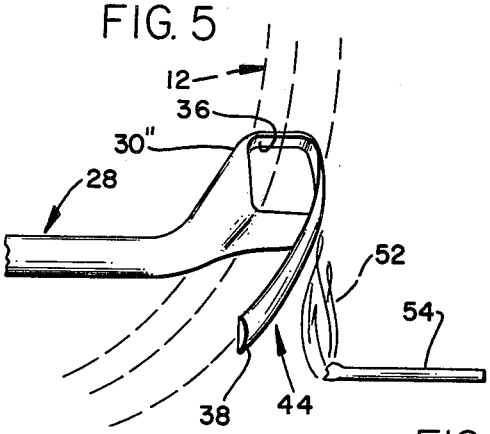
FIG. 5 is an enlarged partial perspective view of the present invention which discloses the manner in which the ring guard is attached to a finger ring.

In FIG. 5 the socket 30" is being formed by wrapping the transverse members about the shank of the ring, with the transverse members being laid upon one another, such that one end portion 36, for example, terminates within the socket while the remaining end portion 38 terminates outside the socket.

A source of heat 52 of sufficient intensity to produce a temperature which will heat-seal the heat-meltable components of the socket is provided by any suitable heating apparatus, as for example, a flame from a match 54.

Figure 6:
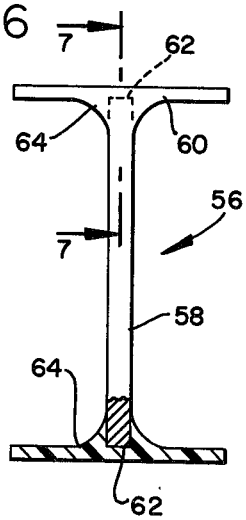
FIG. 6 is an enlarged top-plan view of a modification of the apparatus disclosed in FIG. 2, with some parts thereof being shown in cross-section; and, FIG. 7 is a broken cross-sectional view taken along lines 7—7 of FIG. 6.
Figure 7:
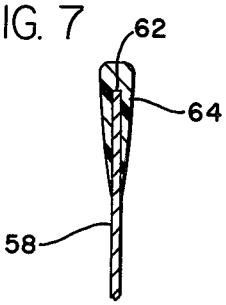

In the alternate embodiment of FIG. 6, a ring guard 56 includes a combination plastic and resilient metal main body portion 58 which is affixed to opposed plastic lateral members 60 and 64. The heat-moldable lateral members extend transverse of the main body, with the marginal ends 62 of the metal insert member terminating in fixed relationship embedded within the plastic material. The configuration of the guard seen in FIGS. 6 and 7 may be made identical to the embodiment of FIGS. 1 thru 5.

In one embodiment of the invention the marginal end of a transverse member is apertured by the provision of a slit of limited length therein as seen illustrated in FIG. 6 by the numeral 66. This modification of the previous embodiments of the invention enables a more unified bond to be achieved by the socket forming transverse members. One transverse member is placed through the slit formed in the opposed transverse marginal end and the juncture is then melted together by the application of a suitable source of heat.

In the form of the invention disclosed in FIGS. 1-5 it would be desirable to fabricate the central body 32 of a plastic having great resilience as compared to the composition of the lateral members. This desirable feature provides a suitable spring force at 32 while providing members at 36 and 44 which may be easily wrapped about the ring shank and heat sealed onto one another.

The present invention can be used by persons of both sexes in order to secure any type finger ring to any one of the digits of the hand. The apparatus is especially beneficial for persons who have large knuckles and therefore must employ means for eliminating the looseness of a ring. Others can employ the present invention to advantage where they prefer not to modify an oversize ring by reducing its diameter. Moreover, the present invention avoids mutilation of one's fingers in the event the ring is inadvertently caught in equipment.

The guard of the present invention is permanently attached to the ring and must be destroyed in order that it may be removed. The guard is easily removed by cutting the opposed sockets with a small pair of wire cutters or scissors.

After the guard of the present invention is installed on the ring, the sockets are each slideably mated to spaced opposed marginal portions of the ring shank. The guard therefore can slide upward and downward as the main body thereof is deformed. Accordingly, as the combination of FIG. 1 is telescopingly received over one's finger, the mid-body portion is deformed toward the bottom 22 of the shank while the opposed, upwardly curved, marginal portions are deformed toward the inner peripheral surface of the shank. As this action occurs the sockets each slide toward the bottom 22 of the ring and hence towards one another. At the same time, the upwardly curved marginal portions are brought to bear against the inside of the shank surface. The amount of deformation of the main body determines the extent with which the outside surface of member 34 is brought to bear against the inside surface of the shank.

Accordingly, the main body portion of the guard can be deformed in a downward direction into contact with the lowermost inner wall of the shank as the ring is fitted onto one's finger. After the ring has passed over the knuckle onto the reduced diameter portion of the finger, the mid-section 32 will be biased away from the shank portion 22 with the marginal ends 34 curvingly engaging an inner marginal area of the shank an amount depending upon the difference in size between the ring and one's ring finger.

Hence the spring action of the ring guard maintains a constant friction against one's finger, with the ring guard and the inside peripheral surface of the shank jointly cooperating together to effect contact with the entire outside skin area of one's ring finger. This desirable expedient generates a maximum amount of comfortable friction for a minimum loss of circulation and effectively prevents rotation or any undue looseness of the ring upon the finger.

The present invention preferrably is made of a polymer type plastic product and provides for temporary or permanent sizing of any type ring made of any finish, and is durable and economical in use. The ring guard of the present invention can be installed by a layman without the necessity of any special tools. The ring guard avoids metal-to-metal contact between the guard and the ring and will not discolor one's finger over a long period of time.

The plastic material of the present invention can be made transparent which enables it to be used with a ring of any type finish and furthermore without being obvious to the ordinary observer. The convex shape of the ring guard provides comfort by conforming to the contour of one's finger.

I claim:

1. A guard for a finger ring, said guard being of unitary construction and including a finger-engaging mid-section (32), opposed socket-forming members and opposed marginal end portions (34);

said opposed marginal end portions being joined to said mid-section, and upwardly curving away therefrom;

each of said opposed socket-forming members having a marginal central portion and including two transverse members (36, 38) joined together at said marginal central portion with the two transverse members each having a free end portion which is directed away from said mid-section;

said marginal central portion being joined to the end of said marginal end portion which is remote from said mid-section;

said guard being of a size to be positioned with the mid-section thereof located within a finger ring while each of the transverse members lies adjacent one of opposed lengths of the ring shank therewithin, and each pair of said transverse members being adapted to be wrapped about the shank and melted into the form of the aforesaid socket such that the socket slidably captures opposed marginal lengths of the shank therewithin.

2. Apparatus for adjustably compensating for the difference in size of a finger ring respective to the size of one's finger, comprising a guard of unitary construction which is readily attachable in a permanent manner to a finger ring;

said guard having an elongated resilient finger-engaging central body, and opposed upwardly curved marginal ends which terminate in opposed socket-forming members for slidably engaging the shank of a ring;

each of said socket-forming members being made of heat-meltable plastic, and including a marginal central portion from which a pair of transverse members extend, said transverse members being bendable about a ring shank and capable of being heat-melted into a unitary socket which slidably captures the shank of a ring therein; said marginal central portion being joined to the end of said upwardly curved marginal end;

so that said mid-portion can be placed adjacent to the inner surface of the shank of a ring and said transverse members of the respective socket-forming members wrapped about the shank and back onto one another, whereupon the transverse members can be heated and fused into the aforesaid sockets.

* * * * *